United States Patent [19]

Kistrup et al.

[11] Patent Number: 4,925,706

[45] Date of Patent: May 15, 1990

[54] PROCESS FOR THE CHEMICAL METALLIZING OF TEXTILE MATERIAL

[75] Inventors: Holger Kistrup, Esslingen; Claus von Benda, Nürtigen, both of Fed. Rep. of Germany

[73] Assignee: Deutsche Automobilgesellschaft mbH, Fed. Rep. of Germany

[21] Appl. No.: 257,120

[22] Filed: Oct. 11, 1988

Related U.S. Application Data

[63] Continuation of Ser. No. 78,762, Jul. 28, 1987, abandoned.

[30] Foreign Application Priority Data

Oct. 31, 1986 [DE] Fed. Rep. of Germany ..... 3637130

[51] Int. Cl.[5] ..... B05D 3/04

[52] U.S. Cl. ..... 427/305; 427/304; 427/306

[58] Field of Search ..... 427/304, 305, 306

[56] References Cited

U.S. PATENT DOCUMENTS

| | | | |
|---|---|---|---|
| 3,666,550 | 5/1972 | Okuhashi et al. | 427/305 |
| 3,864,148 | 2/1975 | Maeawa | 118/320 |
| 3,877,965 | 4/1975 | Broadbent | 427/304 |
| 3,967,010 | 6/1976 | Maekawa | 427/306 |
| 4,087,586 | 5/1978 | Feldstein | 427/306 |
| 4,201,825 | 5/1980 | Ebneth | 427/306 |
| 4,645,574 | 3/1987 | Orban | 427/306 |
| 4,835,015 | 5/1989 | Kistrup | 427/306 |

FOREIGN PATENT DOCUMENTS

| | | | |
|---|---|---|---|
| 1197720 | 7/1965 | Fed. Rep. of Germany . | |
| 1804042 | 5/1970 | Fed. Rep. of Germany | 427/306 |
| 2250309 | 4/1973 | Fed. Rep. of Germany | 427/306 |
| 2743768 | 3/1980 | Fed. Rep. of Germany . | |
| 3243190 | 5/1984 | Fed. Rep. of Germany | 427/305 |
| 8304268 | 12/1985 | PCT Int'l Appl. . | |
| 1142131 | 2/1969 | United Kingdom . | |
| 2005310 | 4/1979 | United Kingdom . | |
| 2196651 | 5/1988 | United Kingdom | 427/304 |

OTHER PUBLICATIONS

English Translation of German Patent 2,250,309 to Kuraray Co., Apr. 13, 1973.

*Primary Examiner*—Shrive Beck
*Assistant Examiner*—Vi Duong Dang
*Attorney, Agent, or Firm*—Evenson, Wands, Edwards, Lenahan & McKeown

[57] ABSTRACT

A process is described for the chemical metallization of textile fibers or textile fibrous structures by treating the textile fibrous structure with an activating solution, removing excess activating agent, and without any further intermediate treatment, bringing the fiber into contact with a chemical metallizing solution.

22 Claims, No Drawings

PROCESS FOR THE CHEMICAL METALLIZING OF TEXTILE MATERIAL

This is a continuation of application Ser. No. 078,762, filed July 28, 1987, and now abandoned.

BACKGROUND AND SUMMARY OF THE INVENTION

The invention relates to a process for the chemical stabilizing of textile material, particularly by using an activating solution and subsequently coating the material with metal.

Known metallization of textile material includes the following procedures.

The material to be metallized is treated for some seconds to a few minutes with an activating solution preferably at room temperature. The activating solution contains palladium in ionic, colloidal or finely dispersed form and tin (II) salts which should be present in excess. The pH value of the solution should always be smaller than 1.

The material thus activated is then rinsed with water until the wash water gives a neutral reaction. This may require a rinse operation in several stages. Thereafter, the rinsed material is treated in an acid or alkaline medium, for example 5% strength sulfuric acid or 5% strength sodium hydroxide solution. This treatment is referred to as accelerating or hydrolysis. It serves to free the surface of the catalyst particles (palladium or palladium/tin particles) adhering to the fiber from excess tin gel hydrate (stannic acid). This is followed by a further rinse to remove excess treatment medium.

After this last rinse, the textile material is subjected to a treatment with an alkaline metal salt bath, during which the prescription of the metal onto the textile material takes place. Such a process has been described in detail, for example, in German Published Unexamined Patent Application No. 2,743,768.

The various treatment and wash operations give rise to large amounts of wastewater which needs to be treated not only to recover valuable substances, but in particular, to remove heavy metals present therein, to protect the environment. These cleaning operations are relatively costly, in particular because the wastewaters need to be very pure.

An object of the invention is to provide a process for the chemical metallizing of textile material which is substantially simpler, and in which the amount of the wastewater to be treated is substantially reduced.

These objects are achieved by providing a process for the chemical metallizing of textile material by activating the textile material by means of an activating solution which contains tin (II) ions and palladium in ionic, colloidal or finely dispersed form, and subsequently coating it with metal in a currentless fashion from an alkaline metallizing solution. First, the textile material is impregnated with an activating solution. Excess activating solution is then removed from the pores of the textile material mechanically. The textile material is then brought directly into contact with the metallizing solution without further intermediate treatments, and the textile material is coated with metal.

It was found, surprisingly, that the wash and rinse operations and the accelerating between the impregnating of the fiber surface with the activating solution and the treatment with the chemical metallizing solution are dispensable. It is assumed that the processes of the hydrolysis or accelerating steps can still take place even if the fiber surface wetted with the activating solution is already in the metallizing solution without thereby impairing the metallization. The only step required between the activation and the chemical metallization of the textile material in the process is the removal of excess activating solution from the pores of the textile material in a conventional mechanical manner.

According to advantageous features of certain preferred embodiments of the invention, this removal of excess activating solution can be effected, for example, by centrifuging, squeezing off with rolls, or blowing out with air and the like. After this mechanical removal of excess activating liquor, the fiber is still wet with the activating solution. Without any further treatment, the textile material is then brought into contact with the metallizing solution and becomes coated with the desired metal.

According to advantageous features of certain preferred embodiments of the invention, suitable textile materials are filaments, fibers and textile structures, in particular, fleece material and needled felt. In certain preferred embodiments of the invention, particular preference is given to a fleece material or needled felt which has a fiber linear density of 1.3–3.7 dtex, a porosity of 50% to 90%, and a thickness of 1–10 mm. In certain preferred embodiments of the invention, the preferred fiber material is polyethylene or polypropylene, but in principle it is also possible to use other textile material made of filaments or fibers from fiber-forming synthetic polymers composed of acrylonitrile polymers, vinyl, polyester, polymodacrylic, polyvinyl halides or other polyalkalenes.

The preparation and composition of the activating solutions is well known to those skilled in the art and is described, for example, in German Published Unexamined Patent Application No. 1,197,720.

The metallizing solutions have likewise been known for a long time. According to certain preferred embodiments of the invention, the metallizing solutions or baths are preferably baths of nickel salts, cobalt salts or mixtures thereof, copper salts, gold salts or other salts which can be deposited from alkaline baths In certain preferred embodiments, very particular preference is given to ammoniacal nickel baths or NaOH-based copper baths. It is, of course, also possible to use mixtures of ammonia and sodium hydroxide solution to maintain the desired pH value.

In this process, the numerous hitherto customary process steps between the activation and the chemical metallization can be dispensed with, resulting in appreciable cost savings in the disposal of wash liquors. The quality of the chemical metallization is not in any way impaired.

The textile material metallized by the process described can be used, if desired after increasing the thickness of the metal coat by electroplating, for panel heaters, electromagnetic fields against radio waves, as electrode supports and the like.

DETAILED DESCRIPTION OF THE INVENTION

The invention will be described further in connection with the following specific examples, but it is to be understood that these are merely illustrative in nature and not intended to limit the invention thereto.

EXAMPLE 1

A needled felt web of polyethylene having a nominal thickness of 3.5 mm, a width of 800 mm and a length of 1510 mm, and also a porosity of 92% was impregnated at room temperature with an activating solution which contained 0.5 g of palladium (II) chloride/l, 30 g of tin (II) chloride and 60 g of hydrochloric acid/l (d=1.19).

After removal of the spent activating solution from the pores of the needled felt web by squeezing off between two rolls, the needled felt web was directly dipped into a chemical nickeling solution. The solution contained 24 g/l of nickel (II) chloride and 50 g/l of sodium hypophosphite. Sufficient ammonia was added to this solution to bring it to pH 8–10 at 30°. Nickeling was complete after about 30 minutes. The textile material was freed from spent nickeling solution by squeezing off and by washing with water and was then dried.

As a result of this process, all of the fibers of the needled felt had been uniformly nickeled and therefore could also be electroplated with nickel in an extremely uniform manner. The omission of the customary accelerating and hydrolysis solutions and of the wash steps had no adverse effects whatsoever on the quality of the chemical metallization.

EXAMPLE 2

A fleece material web of polypropylene having a nominal thickness of 4 mm, a width of 400 mm and a length of 25 m, and also a porosity of 95% was activated with a commercially available Pd/Sn-based activating solution. After 20 minutes, excess activating solution was centrifuged off the fleece material web.

The polypropylene web was then coppered at pH 12.5 in a chemical coppering bath containing 50 g of copper sulfate/l, 50 g of sodium potassium tartrate/l, 20 g of sodium hydroxide/l and 100 g of formaldehyde/l. After removal of the spent coppering solution, inspection under the microscope showed no fiber on which copper had not been deposited. Also, in this case, the omission of the washing and rising solutions between activation and chemical metallization had no adverse effects whatsoever on the metallization.

Although the present invention has been described and illustrated in specific examples, it is to be clearly understood that the same is by way of illustration and example only, and is not to be taken by way of limitation. The spirit and scope of the present invention are to be limited only by the terms of the appended claims.

What is claimed:

1. Process for the chemical metallizing of textile material having pores by activating the textile material by means of an activating solution which contains tin (II) ions and palladium in ionic, colloidal of finely dispersed form and subsequently coating it with metal in a currentless fashion from an alkaline metallizing solution, consisting essentially of:

impregnating the textile material with the activating solution;

pressing out excess activating solution from the pores of the impregnated textile material to provide a textile material still wet with activating solution prior to plating with metal; and bringing the textile material directly into contact with the metallizing solution without a washing and rinsing operation and coating the textile material with metal.

2. Process as in claim 1, wherein said impregnating includes using textile material in the form of one of fleece material or needled felt which has a fiber linear density of 1.3–3.7 dtex, a porosity of 50% to 97% and a thickness of 1–10 mm.

3. Process as in claim 2, wherein said impregnating includes using textile material in the form of fleece material.

4. Process as in claim 2, wherein said impregnating includes using textile material in the form of needled felt.

5. Process as in claim 1, wherein said impregnating includes using textile material in the form of one of fleece material or needled felt.

6. Process as in claim 5, wherein said impregnating includes using textile material which has a fiber linear density of 1.3–3.7 dtex.

7. Process as in claim 5, wherein said impregnating includes using textile material having a porosity of 50% to 97%.

8. Process as in claim 5, wherein said impregnating includes using textile material having a thickness of 1–10 mm.

9. Process as in claim 1, wherein said coating of the textile material includes coating with one of nickel and copper.

10. Process as in claim 9, wherein said coating of the textile material includes coating with nickel.

11. Process as in claim 9, wherein said coating of the textile material includes coating with copper.

12. Process as in claim 1, wherein said removing of excess activating solution includes centrifuging.

13. Process as in claim 1, wherein said removing of excess activating solution includes mechanical squeezing.

14. Process as in claim 1, wherein said removing of excess activating solution includes using an air current.

15. Process for chemical metallizing of textile material consisting essentially of:

impregnating the textile material with an activating solution;

pressing out excess activating solution from the impregnated textile material to provide textile material still wet with activating solution prior to plating with metal; and bringing the textile material directly into contact with a metallizing solution without a washing and rinsing operation and coating the textile material metal.

16. Process as in claim 15, wherein said impregnating of the textile material includes using an activating solution which contains tin (II) ions and palladium in one of ionic, colloidal and finely dispersed form.

17. Process as in claim 15, wherein said coating includes coating with metal in a currentless fashion from an alkaline metallizing solution.

18. Process as in claim 15, wherein said impregnating includes using textile material in the form of one of fleece material or needled felt which has a fiber linear density of 1.3–3.7 dtex, a porosity of 50% to 97% and a thickness of 1–10 mm.

19. Process as in claim 15, wherein said coating of the textile material includes coating with one of nickel and copper.

20. Process as in claim 15, wherein said pressing out of excess activating solution includes removing excess activating solution from pores of the textile material.

21. Process for the chemical metallizing of textile material having pores by activating the textile material by means of an activating solution which contains tin (II) ions and palladium in ionic, colloidal or finely dispersed form and subsequently coating it with metal in a currentless fashion from an alkaline metallizing solution, consisting essentially:

impregnating the textile material with the activating solution;

pressing out excess activating solution from the pores of the impregnated textile material to provide a textile material still wet with activating solution; and immediately bringing the textile material directly into contact with the metallizing solution without a washing and rinsing operation and coating the textile material with metal.

22. Process as in claim 21, wherein said pressing out includes at least one of the following steps, centrifuging, mechanical squeezing and blowing air.

* * * * *